United States Patent [19]

Studtmann et al.

[11] 4,387,556

[45] Jun. 14, 1983

[54] APPARATUS FOR LIFTING A BOBBIN FROM A SPINDLE

[75] Inventors: Rainer Studtmann; Erich Bock, both of Ingolstadt, Fed. Rep. of Germany

[73] Assignee: Schubert & Salzer, Ingolstadt, Fed. Rep. of Germany

[21] Appl. No.: 241,217

[22] Filed: Mar. 6, 1981

[30] Foreign Application Priority Data

Mar. 11, 1980 [DE] Fed. Rep. of Germany ..... 3009275

[51] Int. Cl.[3] ..... D01H 9/04

[52] U.S. Cl. ..... 57/273; 57/266; 242/46.2

[58] Field of Search ..... 57/112, 129, 130, 132, 57/266, 270, 272, 273, 274, 275; 242/18 R, 41, 46.2, 81

[56] References Cited

U.S. PATENT DOCUMENTS

| | | | |
|---|---|---|---|
| 2,746,691 | 5/1956 | Hoad | 242/46.2 |
| 3,466,863 | 9/1969 | Wachensorf | 57/273 |
| 3,962,856 | 1/1976 | Weller et al. | 57/273 |

FOREIGN PATENT DOCUMENTS

| | | | |
|---|---|---|---|
| 2441060 | 3/1976 | Fed. Rep. of Germany | 242/46.2 |

*Primary Examiner*—Donald Watkins
*Attorney, Agent, or Firm*—Julian W. Dority

[57] ABSTRACT

An apparatus for lifting a bobbin set up on a spindle of a textile machine, in particular a wrap spinning machine characterized in that at least an end of the bobbin remote from the free end of a spindle has a ring of electrically conductive, non-ferromagnetic material. The ring is arranged with its end face opposite a magnetic coil which can be connected to a current source supplying alternating current.

6 Claims, 4 Drawing Figures

APPARATUS FOR LIFTING A BOBBIN FROM A SPINDLE

BACKGROUND OF THE INVENTION

Manual removal of a bobbin from a spindle, which always takes place when the yarn supply on the spindle is used up or a yarn winding being formed on the bobbin is completed, is often made difficult by binding of the bobbin on the spindle or by a housing which hinders access to the bobbin.

In order to be able to remove cops or bobbins jammed on spindle shafts without use of great force, it was previously proposed to arrange displaceable washers beneath the cop sleeve or bobbin, able to be coupled to a press-off mechanism which can be raised or lowered (DE-OS No. 2,334,012, equivalent to U.S. Pat. No. 3,962,856). It is further known to effect the release and doffing of the cop on ring spinning or ring twisting machines by means of a liftable fork bench or fork rail with forks or round pins which act on the yarn body (DE-Gm No. 1,980,127, equivalent to French Pat. No. 1,583,009; DE-OS No. 2,150,212).

These known apparatuses are costly on a plant scale and can lead, when put in operation, to damage to the yarn body or the sleeves. Apart from this, the possibility of their use is restricted. They can only be used for doffing or raising bobbins which present a free working surface, but not with bobbins which are surrounded by a housing, as is the case, for example, with wrap spinning apparatuses (DE-OS No. 2,753,349, equivalent to U.S. Pat. No. 4,170,101).

SUMMARY OF THE INVENTION

The object of the present invention is to produce an apparatus which makes possible in a simple manner the lifting of bobbins without damage to them and which can also be used with bobbins to which access is difficult, where 'bobbins' is to be understood to mean both wound and empty bobbins.

This object is achieved according to the invention in that at least the end of the bobbin remote from the free end of the spindle has a ring of electrically conductive, non-ferromagnetic material which is arranged with its end face positioned opposite a magnet coil which can be connected to a current source supplying alternating current.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

DESCRIPTION OF A PREFERRED EMBODIMENT

The apparatus is described below with reference to a wrap spinning apparatus, for which it is in particular provided. However, it is also usable with other textile machines, for example, flyers and ring spinning or ring twisting machines.

Figure 1:
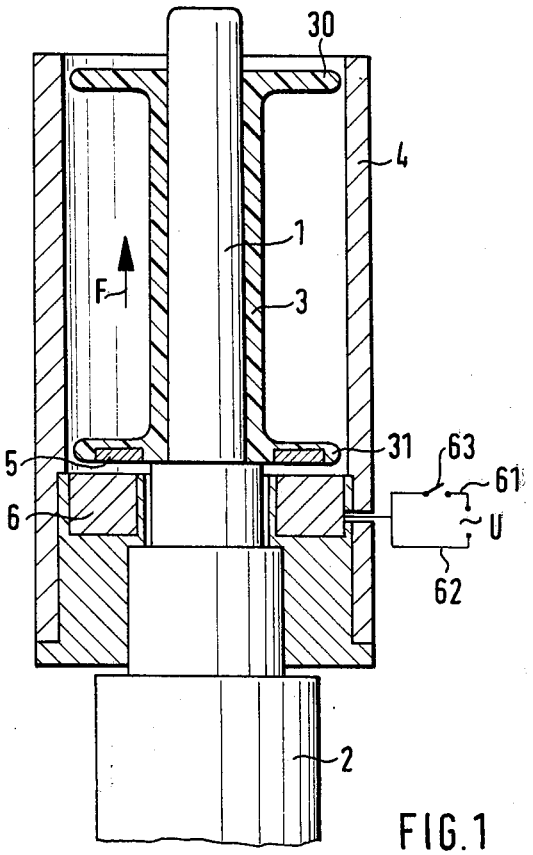
FIG. 1 is a partial view of a wrap spinning apparatus with the bobbin lifting apparatus according to the invention in longitudinal section.

The part of a wrap spinning apparatus shown in FIG. 1 contains a spindle 1, which is constructed as a hollow spindle and is mounted in a spindle bearing 2. A bobbin 3 with respective disks 30 and 31 is put on the spindle 1. Such flanged bobbins are used preferably in wrap-spinning for the supply of a wrap yarn. In the present case, the bobbin 3 consists of plastic and is located in a housing 4 which concentrically surrounds the bobbin 3 and acts as a balloon limiting pot for the wrap yarn running off the bobbin 3 in operation with the formation of a balloon.

A ring 5 of an electrically conductive, non-ferromagnetic material, preferably aluminum, is set into the disk 31 of the bobbin 3 remote from the free end of the spindle 1, and appropriately ending flush with the surface of the disk. If necessary, such a ring 5 can also be provided on the disk 30, so that the bobbin 3 can be set either way on the spindle 1.

A magnet coil 6 is arranged in the machine frame opposite the end face of the ring 5, with its ferromagnetic core formed by the spindle bearing 2. The magnet coil 6 is connected via leads 61, 62 and a switch contact 63 to a current source supplying alternating current.

When the bobbin 3 has to be taken from the spindle 1, the switch contact 63 is closed. The alternating current now flowing through the magnet coil 6 causes a voltage to be induced in the electrically conducting, though non-ferromagnetic, ring 5. Hence there arises a magnetic field which is opposed to the magnetic field of the magnet coil 6, and, as indicated by the arrow, acts as force F in the doffing direction of the bobbin 3, so that it is lifted and projects from the housing 4. The bobbin 3 can now be gripped by hand or by a doffing apparatus and completely withdrawn from the spindle 1. If necessary, however, the magnetic field exerting the force F can also be made stronger, such that the bobbin 3 is completely pushed from the spindle 1.

Figure 3:
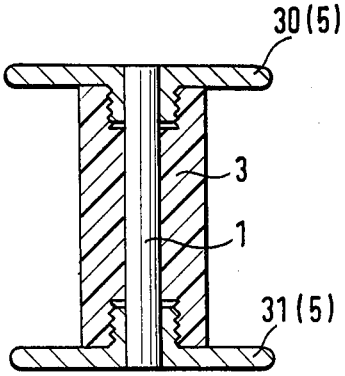
FIGS. 2 through 4 illustrate modifications of the apparatus of FIG. 1, in longitudinal section.
Figure 2:
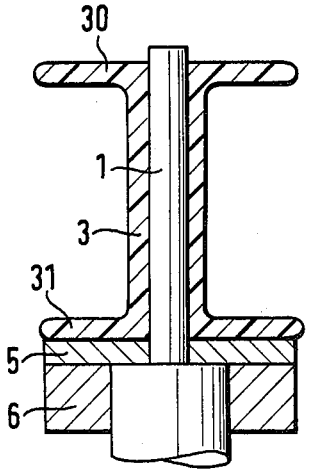

The arrangement of the ring 5 on the bobbin can take place in various ways, for example, as shown in FIG. 2, it is attached externally of the disk 31 of the bobbin 3 facing the magnet coil 6 remote from the free end of the spindle 1. When the bobbin 3 does not rotate with the spindle 1, the ring 5, as shown, can also seat on the magnet coil 6. There is the further possibility of making the disks 30 and 31, or at least the disk 31 remote from the free end of the spindle 1, of an electrically conductive, non-ferromagnetic material and attaching it to the cylindrical part, consisting of plastics, of the bobbin 3, so that the ring 5 is formed by the bobbin disk itself (FIG. 3). Likewise, the bobbin 3 can consist completely of aluminum or another electrically conductive, non-ferromagnetic material. Furthermore, the bobbin can consist of plastics and be coated or jacketed at least partially with an electrically conductive, non-ferromagnetic material.

Figure 4:
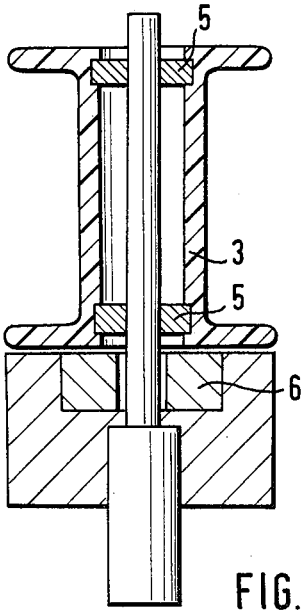

In the embodiment according to FIG. 4, a respective ring 5 is attached to the inner wall of the bobbin 3 in the neighborhood of each end of the bobbin 3, and at the same time acts as a mounting for the bobbin on the spindle 1.

Use of the invention, described in connection with a flanged bobbin, with a wound or non-wound sleeve is effected in a corresponding manner. Here the sleeves, at at least its end remote from the free end of the spindle, can consist or be jacketed with an electrically conductive, non-ferromagnetic material, or a ring 5 of this material is attached to its outer periphery or to its inner wall.

While a preferred embodiment of the invention has been described using specific terms, such description is for illustrative purposes only, and it is to be understood that changes and variations may be made without departing from the spirit or scope of the following claims.

What is claimed is:

1. Apparatus for lifting a bobbin set up on a spindle of a textile machine comprising:

a ring of electrically conductive, nonferromagnetic material carried on at least one end of the bobbin remote from a free end of said spindle, and an electrically excitable magnet coil carried adjacent a base of said spindle;

said ring being arranged on said bobbin with its end face opposite said magnet coil.

2. Apparatus according to claim 1 further comprising:

a pair of spaced disks carried on opposed ends of said bobbin, said ring being arranged on one of said disks remote from the free end of the spindle when mounted thereon.

3. The apparatus according to claim 1, further comprising:

a disk carried on an end of said bobbin remote from the free end of said spindle, said disk forms said ring.

4. Apparatus in accordance with claim 1 further comprising:

an inner wall provided on said bobbin;

said ring being attached to said inner wall and acting as a mounting for said bobbin on said spindle.

5. Apparatus according to claim 1, characterized in that said ring consists of aluminum.

6. Apparatus according to claim 1, characterized in that said bobbin is constructed of plastic and is jacketed with an electrically conductive, non-ferromagnetic material.

* * * * *